US005286020A

United States Patent [19]

Caruso

[11] Patent Number: 5,286,020

[45] Date of Patent: Feb. 15, 1994

[54] MEDICINE BALL

[76] Inventor: Andrew Caruso, c/o Kwik Goal Ltd., 140 Pacific Dr., Quakertown, Pa. 18951

[21] Appl. No.: 788,433

[22] Filed: Nov. 6, 1991

[51] Int. Cl.[5] ..... A63B 41/00

[52] U.S. Cl. ..... 273/58 BA; 273/65 B; 273/65 E

[58] Field of Search ..... 273/58 R, 58 B, 58 BA, 273/65 R, 65 A, 65 B, 65 E, 65 D, 65 ED, 65 F

[56] References Cited

U.S. PATENT DOCUMENTS 2,218,919 10/1940 Madsen ..... 273/65 B
4,462,590 7/1984 Mitchell ..... 273/65 ED
4,738,450 4/1988 Wexler ..... 273/65 R
4,834,382 5/1989 Spector ..... 273/58 BA
4,917,381 4/1990 Spector ..... 273/58 BA

*Primary Examiner*—Vincent Millin
*Assistant Examiner*—Steven B. Wong
*Attorney, Agent, or Firm*—Richard L. Miller

[57] ABSTRACT

A medicine ball construction includes a pliable cover of leather with an inflatable rubber bladder within said cover, the bladder wall being thick and the bladder being inflated to a low pressure so that the ball is pliable and light.

2 Claims, 1 Drawing Sheet

MEDICINE BALL

BACKGROUND OF THE INVENTION

1. Field of the Invention

This invention relates to an improved construction for a medicine ball which makes the ball lighter, less expensive to manufacture, easier to throw and catch, and less likely to injure a person who is struck by the ball.

2. Description of the Prior Art

Conventional medicine balls are used to provide aerobic exercise to a person when the ball is thrown or caught. Most medicine balls are relatively heavy and have considerable mass in order to produce optimum expenditure of energy when the ball is in use. The mass is generally provided by surrounding a heavy object with a fibrous material such as loose cotton batting or wadded pieces of cloth. The outside of the ball is generally composed of sections of leather, cloth, rubber or plastic stitched together to forms a spherical covering about the heavy, padded central mass. The outside of the ball is soft and pliable so that it can be grasped more easily when being thrown or caught, and because of its pliable outside and soft cloth inside the ball will deform to a substantial degree when striking a person or object. The force of the impact will be distributed over a larger area than if the ball were firm, and risk of injury to persons or object is considerably reduced. However, because the mass of the ball is great, injuries to persons, especially younger persons or children, may result if the ball is improperly thrown or caught.

Conventional athletic balls such as footballs and basketballs are composed of an inflatable, high strength inner bladder, and an outer layer of heavy leather, rubber or plastic material. Such balls are inflated to high pressure and thrown, kicked or bounced, all of which can cause injuries to fingers as well as other parts of the body, and to property as well.

The present invention uniquely combines the pliability of a standard medicine ball with the ease of manufacture and sturdiness of an inflatable athletic ball to produce an improved medicine ball. The ball may be of any size, but is preferably about the size of a standard soccer ball. It has a sturdy leather or plastic cover and an inflatable inner bladder of sufficient thickness that, at relatively low inflation pressures, permits the ball to be lighter in weight than conventional medicine balls yet pliable so that it is easy to throw and catch, even for children. The lighter ball is less likely to cause injuries, but as with standard medicine balls should not be kicked or headed like a soccer ball.

In its construction the present improved medicine ball is substantially different from the inflatable play ball described in U.S. Pat. No. 4,484,382 to Spector in that the wall of the inflatable bladder of this invention is considerably thicker, adding mass and weight to the ball yet permitting the ball to be pliable when inflated to low pressures. The present invention is also different from the pliant soccer ball having a wound cotton interior as described in U.S. Pat. No. 4,542,902 to Massino, and from the soccer ball with a two-ply butyl floating bladder described in U.S. Pat. No. 4,830,373 to Dehnert et al. The bladder of the present invention does not float, but is secured to the inside of the covering.

It is therefore an object of this invention to provide a unique medicine ball which is smaller and lighter than conventional ball, but which is pliable and easily thrown and caught.

Another object of this invention is a novel construction for a medicine ball wherein the inside is an inflatable bladder with heavy, thick walls which add mass but which are pliable when inflated to low pressures.

A further object of this invention is a small, light weight medicine ball that is easy to construct and is less likely to cause injury.

A still further object of this invention is a novel medicine ball in which a thick-walled rubber bladder is secured about its valve seat to the inside of its covering.

DESCRIPTION OF THE PREFERRED EMBODIMENT

Figure 1:
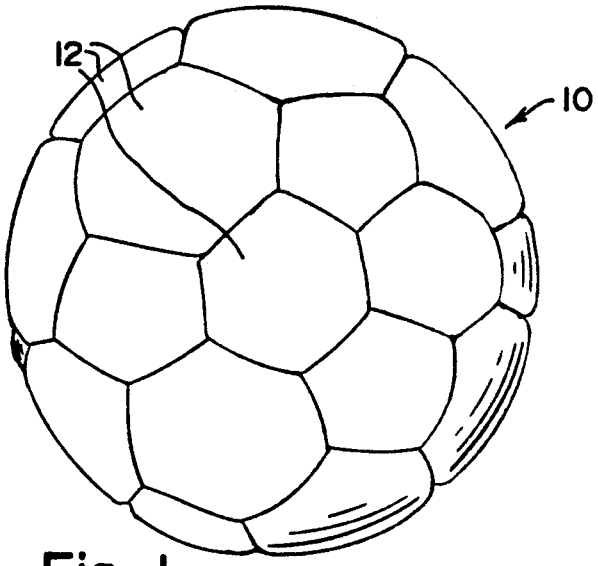
FIG. 1 is a perspective view of the present invention.

In accordance with the present invention, there is shown in FIG. 1 a perspective view of the medicine ball 10. The ball 10 is preferably the size of a soccer ball, although other sizes are within the scope of this invention.

The outside of the ball 10 consists of a plurality of panels 12, typically hexagonally and pentagonally shaped, which are stitched together or otherwise joined in a conventional manner to form a cover 14. The panels 12 are preferably of a strong, durable and resilient material such as leather or plastic, but may be of any other similar material. The outside of the cover 14 preferably has a coating of a waterproof substance such as polyurethane. Butt seams 16 between adjacent panels 12 are shown in FIGS. 2 and 3.

Figure 2:
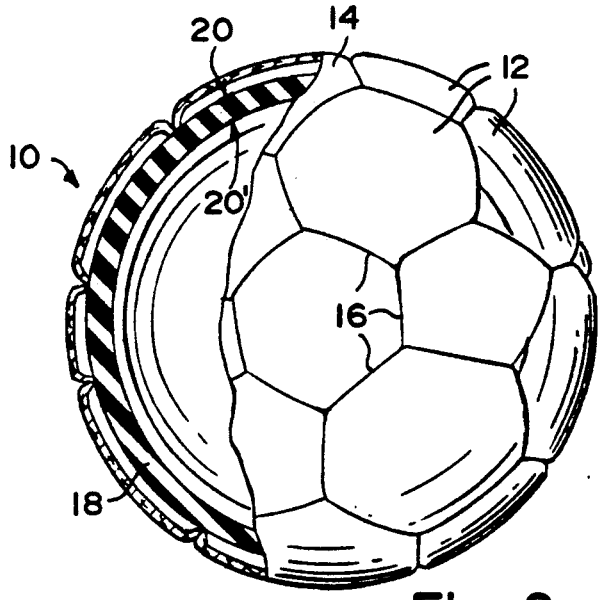
FIG. 2 is a partial cross-sectional view of the present invention.
Figure 3:
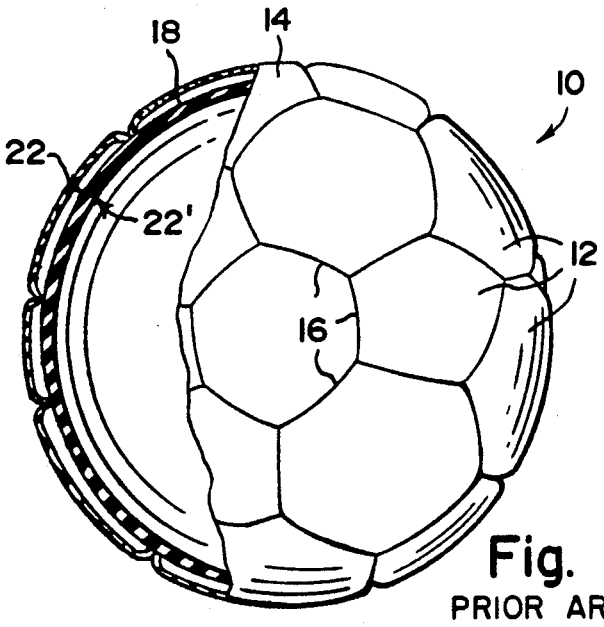
Fig. 3 PRIOR ART
FIG. 3 is a partial cross-sectional view of a typical prior art ball having an inflatable bladder.

The cover 14 is stitched over an inner bladder 18 as shown in FIGS. 2 and 3. The bladder 18 is preferably of one piece, and composed of butyl rubber or the like. The walls of the bladder 18 are quite thick as shown by numerals 20, 20' in FIG. 2, as contrasted with the thinner bladder wall shown at numerals 22, 22' in FIG. 3 representing the prior art. By making the wall of the bladder 18 thick, significant advantages are obtained as will be explained.

The bladder 18 contains a conventional valve, not shown, through which a needle connected with a source of air under pressure may be inserted to inflate the bladder as with conventional sports balls. The valve is exposed through an opening in the cover 14, and the portion of the outside of the bladder surrounding the valve is glued to the inside of the cover so that the valve is always accessible from outside the cover. Gluing the bladder also prevents the bladder, which is inflated to a low pressure, from moving within the cover 14 when the ball is used.

When it is used, the medicine ball is inflated to a low pressure such as 2–10 psi, expanding the bladder so that it will lightly contact the inside of cover 14. At such low pressures the ball is softer, more pliable and more deformable than standard inflatable sport balls, and the ball has a lower coefficient of elastic resolution than conventional sport balls. Because the walls of the bladder 18 are thick and the inflation pressure low, the ball can be grasped easily even by a small child. Because it is pliable, the ball cannot be bounced, and should not be kicked or headed, but a person who is inadvertently struck by the ball is less likely to be harmed than if struck by a conventional sport ball or medicine ball. The internal pressure can easily be modified to vary the pliability of the ball.

As shown in FIG. 2, the thickness of the bladder 18 is substantial as compared with the radius of the ball. In practicing the invention it is preferred that the thickness of the bladder wall be on the order of 0.15 inch or more for a bladder having a diameter of about 7–9 inches, or a ratio of about 0.02 of bladder wall thickness to its diameter. The bladder 18 may be in one piece, or formed of multiple plies or layers.

Although the medicine ball of this invention is smaller than a conventional medicine ball, it is easier to construct, easier to grasp, throw and catch, and is more suitable for use by children or in enclosed spaces. In addition, it is far less likely to cause damage to persons or objects.

While the invention has been described with reference to its preferred embodiment, it is apparent that changes may be made to its construction without departing from the scope of the invention as hereinafter claimed.

What is claimed is:

1. A pneumatic medicine ball comprising:

a) an outer cover of non-stretchable, flexible material adapted to assume a spherical shape and having a small opening therein; and b) a bladder of elastomeric material having a thick, heavy, wall and a valve within said wall, said valve being inserted into the small opening within said outer cover, the thickness of said wall having a ratio of about 0.02 to the diameter of the fully inflated bladder, said bladder being inflated to a pressure of about 2–10 psi so that said ball is sufficiently pliable to be grasped easily by a small child.

2. A medicine ball as in claim 1 in which the outside of said bladder is glued to the inside of said cover for a short distance about said valve and the thickness of said bladder wall is about 0.15 inch and said diameter of said bladder is between 7 and 9 inches.

* * * * *